US005915584A

United States Patent [19]

Sposit et al.

[11] Patent Number: 5,915,584

[45] Date of Patent: Jun. 29, 1999

[54] DEVICE FOR ATTACHING A DISPOSABLE BAG TO A CONTAINER

[75] Inventors: Jon M. Sposit, 4597 Southview Dr., Jupiter, Fla. 33458; Walter E. Gates, Jupiter, Fla.

[73] Assignee: Jon M. Sposit, Jupiter, Fla.

[21] Appl. No.: 08/919,514

[22] Filed: Aug. 28, 1997

[51] Int. Cl.[6] ..... B65D 25/10

[52] U.S. Cl. ..... 220/495.09; 220/495.1; 220/908.1

[58] Field of Search ..... 220/495.1, 495.09, 220/908.1

[56] References Cited

U.S. PATENT DOCUMENTS

| | | | |
|---|---|---|---|
| 4,332,361 | 6/1982 | McClellan . | |
| 4,418,835 | 12/1983 | Watts . | |
| 4,535,911 | 8/1985 | Goulter . | |
| 4,558,800 | 12/1985 | Isgar et al. | 220/495.1 |
| 4,576,310 | 3/1986 | Isgar et al. . | |
| 4,695,020 | 9/1987 | Collins . | |
| 4,735,340 | 4/1988 | Preston . | |
| 4,762,297 | 8/1988 | Milligan . | |
| 4,763,808 | 8/1988 | Guhl et al. . | |
| 4,860,982 | 8/1989 | Berlant . | |
| 4,946,065 | 8/1990 | Goulter et al. | 220/495.1 |
| 5,222,704 | 6/1993 | Light . | |
| 5,314,151 | 5/1994 | Carter-Mann . | |

*Primary Examiner*—Joseph M. Moy
*Attorney, Agent, or Firm*—Finnegan, Henderson, Farabow, Garrett & Dunner, L.L.P.

[57] ABSTRACT

A device for attaching a grocery or retail plastic bag to an existing trash container is disclosed. The device is to be positioned at the top rim of the trash container. The device has a first pair of hooks so that one of the bag handles may be placed internal of the first pair of hooks for bag support and bag attachment to the device. The device further has a second pair of hooks to attach the device to the top rim of the container. The device has a passageway to provide an unobstructed path for the attachment and the removal of the bag in relation to the container and the device. The device fits on containers of varying shapes and rim configurations. The device has a low profile that permits the placement of a lid on the container.

7 Claims, 4 Drawing Sheets

DEVICE FOR ATTACHING A DISPOSABLE BAG TO A CONTAINER

BACKGROUND OF THE INVENTION

1. Field of the Invention

The present invention relates to attaching a plastic bag to a container, and more particularly, to a device that attaches a disposable plastic bag to a household container, such as a garbage container.

2. Description of the Related Art

Most grocery and retail stores utilize plastic bags with handles instead of paper bags. When the consumers return home from the store, the plastic bags are either discarded in the garbage, returned to a recycling location, or attempted to be used as disposable garbage bags. In the past, the consumer has had to engineer a way to keep the bag supported and open to receive the garbage, or a way to attach the bag to the inside of a garbage container.

What is needed is a device that is easy to use, that allows the consumer to utilize the retail store plastic bags as disposable garbage bags, and that maintains the bag in the open position for accepting garbage. While bag holders have been previously disclosed, they generally possess drawbacks that have limited their usage. For example, in U.S. Pat. No. 4,535,911 to Goulter, a trash container attachment is described that is designed to accept a plastic bag handle by way of two formed loops separated by a cross-member, which loops protrude vertically upward from the opening of the container. The attachment is held in place in part by the cross-member, which rests outside the container and secures the attachment by fitting under a lip at the rim of the container. This bag holder has the disadvantage, however, of limiting the types of containers that can be used with it. Namely, because the cross-member provides contact from outside the container, common features present in existing garbage containers, such as handles and gussets, would prevent the proper fitting of the cross-member under the lip of a container. Furthermore, for the cross-member to properly serve its attaching function, the container must have a lip—yet not all containers have lips. The external positioning and lip grabbing design of the cross-member also imparts a stiffness to the attachment that makes it difficult to conform to circular-shaped containers. Yet another disadvantage is the inability to fasten or close a lid on a container containing such attachments, by virtue of the loops that extend upward through and out the opening of the container.

Another bag holder, disclosed in U.S. Pat. No. 4,763,808 to Guhl et al., has similar shortcomings. Guhl et al. describe a bag support with an elevated cross-member that accepts a bag handle. Here, because the profile of the bag support extends above the container, this device also prevents the proper use of a container lid. And as with other devices known to the applicant, application of the Guhl et al. bag support to containers other than square-shaped ones finds little success. Furthermore, this bag support loosens easily, owing in part to the inability of the long members inside the container to retain positive contact with the container wall.

SUMMARY OF THE INVENTION

It is, therefore, an object of the present invention to provide a device that allows the consumer to reuse a retail plastic bag as a disposable garbage bag.

It is also an object of the present invention to provide a device that attaches a plastic bag to the inside of an existing garbage container.

It is also an object of the present invention to provide a device that is easy to use and that does not require modification of an existing garbage container for the device to be utilized.

It is also an object of the present invention to provide a device that maintains a plastic bag in the open position so that the bag may accept garbage.

It is also an object of the present invention to provide a device that positively attaches and locks onto an existing garbage container.

It is also an object of the present invention to allow an unobstructed path for the placement and the removal of a plastic bag in relation to an existing garbage container.

It is also an object of the present invention to provide a device that attaches a plastic bag to a wide variety of garbage containers, even garbage containers that have handles adjacent to the top of the rim and garbage containers that have flip-top lids, as well as garbage containers ranging in shape from circular to polygonal.

It is yet another object of the present invention to provide a device that supports a bag in a garbage container without interfering with the placement of a lid on the garbage container.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a device for attaching grocery or retail plastic bags to an existing trash container. The plastic bags are of the type that have a first handle located at a first lateral side of the bag and a second handle located at a second lateral side of the bag.

The device comprises a formed bracket that is to be positioned at the top rim of an existing trash container. Typically, two brackets will be used on the container. The first bracket is located at a first position at the top rim of the container, and the second bracket is located at the top rim of the container, directly opposite of the first bracket.

Each bracket has a first pair of hooks so that one of the bag handles may be placed internal of the first pair of hooks for bag support and bag attachment to the bracket. The first pair of hooks is latitudinally spaced so that the bag handle is slightly stretched.

Each bracket further has a second pair of hooks to attach the bracket to the top rim of the container. Each bracket may also have a spring means to provide additional fastening means to the container. The second pair of hooks provides a locking feature to the container so that the bracket essentially locks onto the container. The device has minimal contact with the exterior of the container, thereby allowing the device to operate with containers having exterior features such as handles and gussets.

The device has a passageway to provide an unobstructed path for the attachment and the removal of the bag in relation to the container and the bracket.

The device has a low profile that minimally extends above the container rim, thereby permitting placement of a lid on the container.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention, and together with the description, serve to explain the principles of the invention.

DESCRIPTION OF THE PREFERRED EMBODIMENTS

Figure 1:
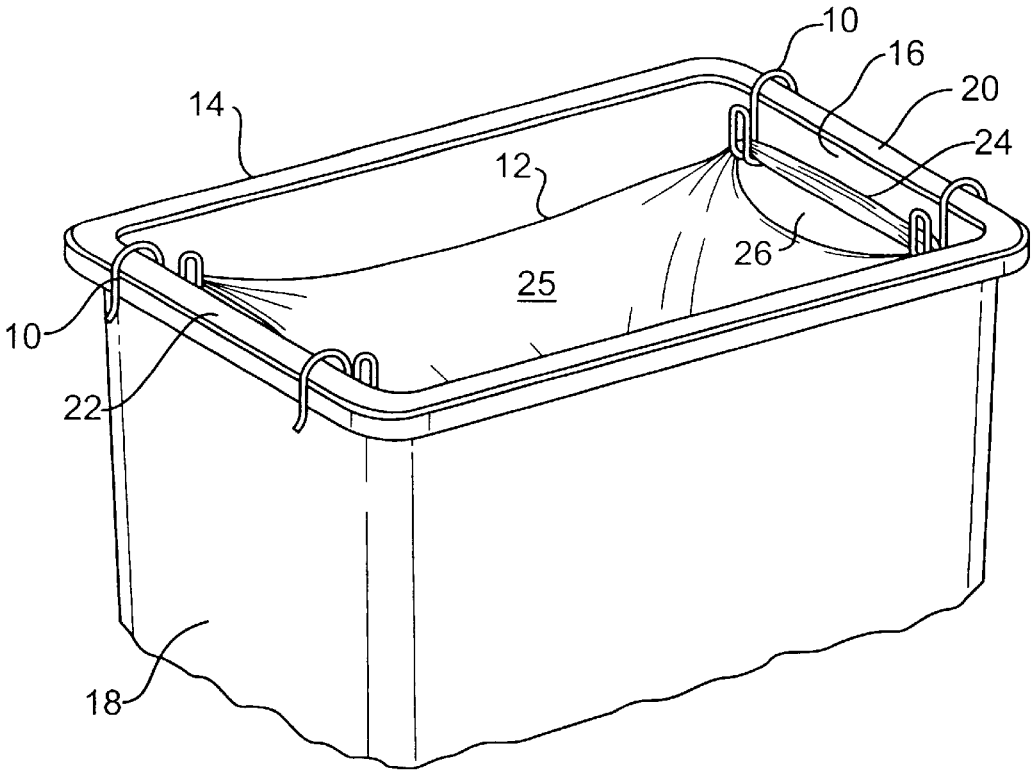
FIG. 1 is a perspective view of a device of the present invention illustrating a pair of the devices attached to the top of a rectangular container.
Figure 2:
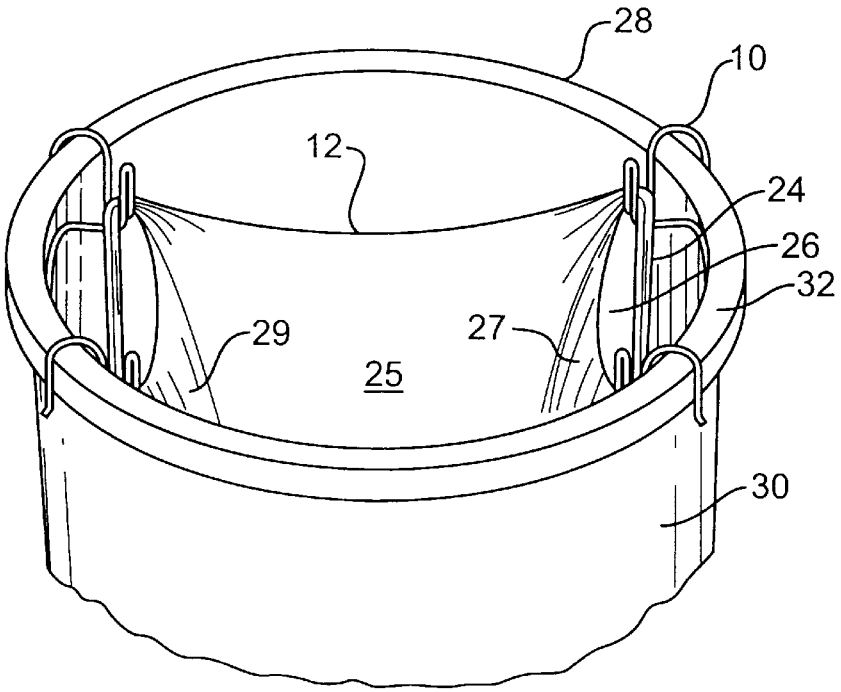
FIG. 2 is a perspective view of the device of the present invention illustrating a pair of the devices attached to the top of a circular container.
Figure 3:
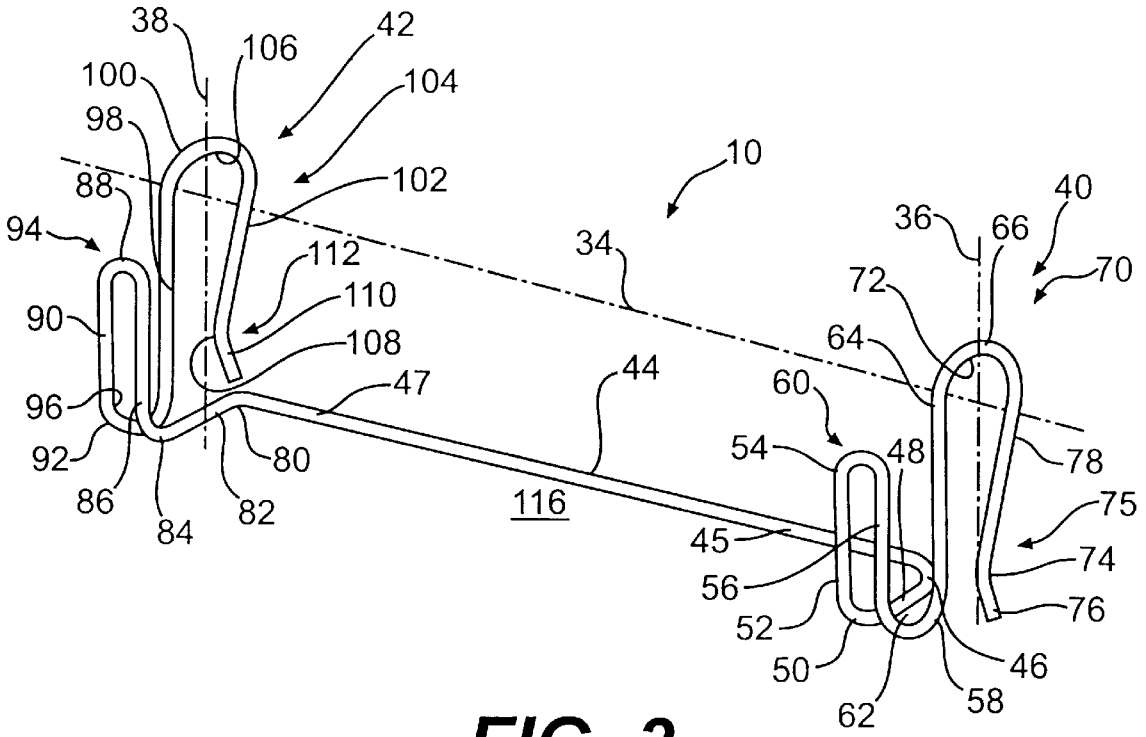
FIG. 3 is a front perspective view of the device of the present invention.
Figure 4:
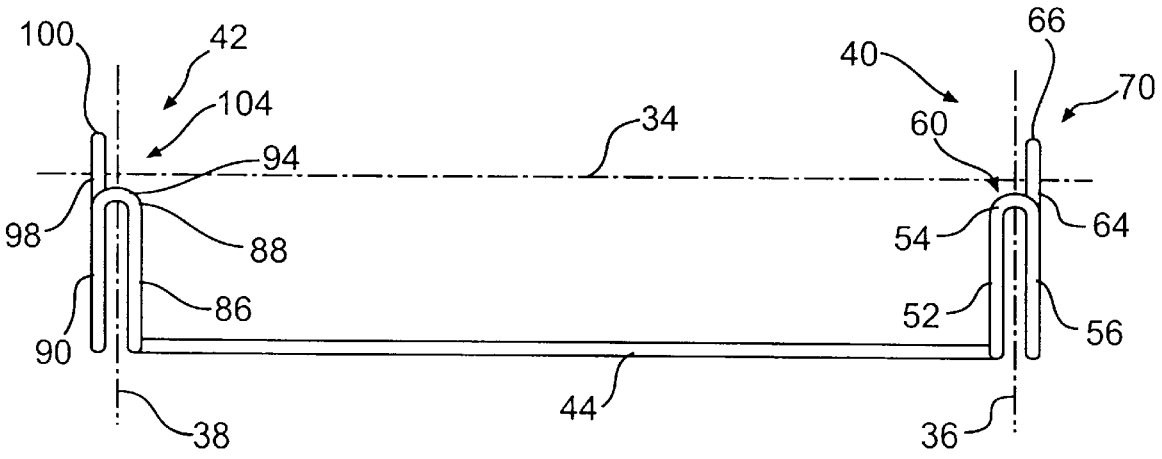
FIG. 4 is a front view of the device of the present invention.

According to the present invention, and as shown in FIGS. 1 and 2, a device, or a bracket, 10 for attaching a plastic bag 12 to a container 14 is disclosed. The plastic bag 12 is of the type that is commonly used in grocery and retail stores. The bag 12 has a first lateral side 27, a second lateral side 29, and a bag opening 25 between the lateral sides 27 and 29. Each lateral side 27 and 29 has a handle 24 and a handle opening 26.

As shown in FIG. 1, a pair of devices 10 is utilized to attach the bag 12 to the container 14. The container 14 is of the type that has a first sidewall 16 and a second sidewall 18. At the top of the first sidewall is a top ridge 20; likewise, at the top of the second sidewall is a top ridge 22.

As described in more detail below, a first device 10 attaches to the top ridge 20, and an identical second device 10 directly opposite of the first device attaches to the top ridge 22. The pair of devices 10 support the bag 12 inside of the container 14 and maintain the bag 12 in the open position so that garbage may be placed in the container 14 with the bag 12 functioning as a plastic garbage bag liner within the container 14.

As shown in FIG. 2, the device 10 may also be utilized with a circular container 28. The circular container has a sidewall 30 with a top ridge 32. A pair of the devices 10 attach to the top ridge 32 and support the bag 12 inside of the container 28 and maintain the bag 12 in the open position.

Figure 8:
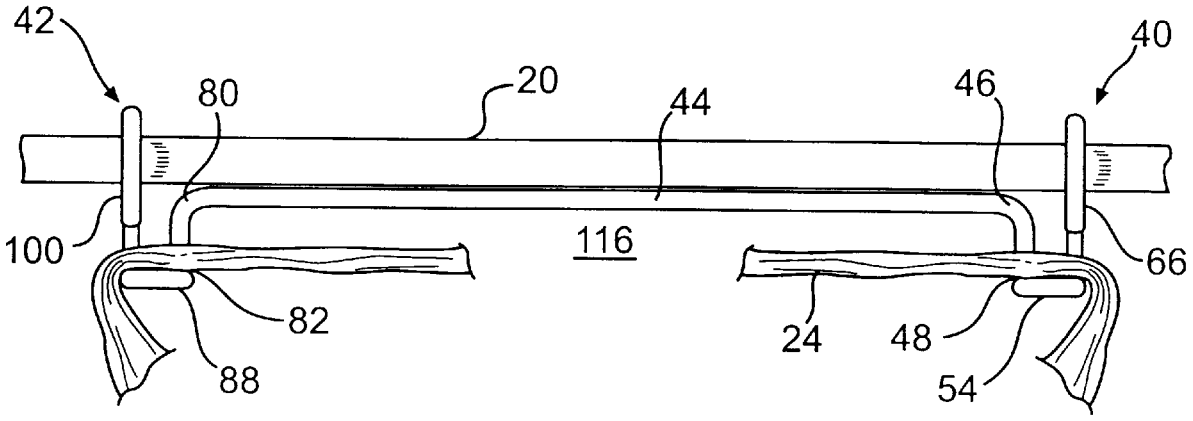
FIG. 8 is a top view of the device of the present invention shown in relation to a container and a plastic bag handle.

As shown in FIGS. 3, 4, 5, and 6, the device 10 has a latitudinal axis 34, a first longitudinal axis 36, and a second longitudinal axis 38. The longitudinal axes 36 and 38 are generally parallel with each other and are generally aligned perpendicular to the latitudinal axis 34. The elements of the device 10 described below are stated in spatial relationship with regard to the device being in use, as shown in FIG. 8, and with regard to the latitudinal axis 34 and the longitudinal axes 36 and 38.

The device 10 has a first lateral side ("FLS") 40 and a second lateral side ("SLS") 42. The lateral sides 40 and 42 are connected by a cross-member 44 and are axially aligned with the latitudinal axis 34. The cross-member 44 has a first end 45 and a second end 47 and is generally linear in shape and is generally parallel with and located below the latitudinal axis 34. The cross-member 44 may alternatively be arcuate in shape, in which case it will be generally concave in shape relation to the first lateral side 40, the second lateral side 42, and latitudinal axis 34. In the arcuate embodiment, the cross-member 44 acts as a spring against the interior of the container wall and thus provides additional positive attachment to a container.

The first lateral side 40 and the second lateral side 42 each have means to attach to the container 14 and each have means to attach to the same plastic bag handle 24.

The first lateral side 40 has a FLS first bend 46 that extends forward at preferably a right angle in relation to the cross-member first end 45 and the latitudinal axis 34. Extending from the FLS first bend 46 is a FLS first section 48, which is perpendicular to the latitudinal axis 34. A FLS second bend 50 extends 90 degrees upward from the FLS first section 48. A FLS second section 52 extends upward from the FLS second bend 50. The FLS second bend 50 and the FLS second section 52 are generally parallel with the first longitudinal axis 36.

A FLS third bend 54 extends 180 degrees laterally and externally from the FLS second section 52. A FLS third section 56 extends downward from the FLS third bend 54 and is generally parallel with and adjacent to the FLS second section 52. The FLS second and third sections 52 and 56 are generally parallel with the first longitudinal axis 36.

A FLS fourth bend 58 extends 180 degrees rearward from the FLS third section 56 with a FLS fourth section 64 extending from the FLS fourth bend 58 so that the FLS fourth section 64 is generally parallel with the FLS third section 56 and so that the FLS fourth section 64 and the FLS third section 56 are perpendicular to the FLS first section 48. The FLS fourth section 64 is spaced slightly from the FLS third section 56 so that the plastic bag handle 24 may be accepted between the FLS third section 56 and the FLS fourth section 64.

The FLS second section 52, the FLS third bend 54, the FLS third section 56, the FLS fourth bend 58, and the FLS fourth section 64 combine to define a FLS first hook 60 and a FLS first slot 62.

The FLS fourth section 64 is generally parallel to the first longitudinal axis 36 and extends beyond the FLS first hook 60. A FLS fifth bend 66 extends greater than 180 degrees rearward from the FLS fourth section 64 with a FLS fifth section 78 extending from the FLS fifth bend 66 at an acute angle in relation to the first longitudinal axis 36 and the FLS fourth section 64. The FLS fourth section 64, the FLS fifth bend 66, and the FLS fifth section 78 are generally perpendicular with the latitudinal axis 34 and combine to define a FLS second hook 70 and a FLS second slot 72. The FLS fifth section 78 is spaced from the FLS fourth section 64 so that the FLS second hook 70 may be positioned over a typical container top ridge, such as top ridge 20 or 32. The FLS fifth section 78 extends from the FLS fifth bend 66 at an acute angle so that the FLS second hook 70 positively attaches to the top ridge of the container.

A FLS sixth bend 74 extends less than 45 degrees rearward from the FLS fifth section 78. A FLS sixth section 76 extends from the FLS sixth bend 74 and is adjacent to the FLS fifth section 78. Preferably, a plastic end cap is installed over the end of the FLS sixth section 76. The FLS sixth section 76 and the FLS fifth section 78 are generally perpendicular to the latitudinal axis 34. The FLS sixth section 76, the FLS sixth bend 74, and the FLS fifth section 78 define a FLS press lock 75 so that the first lateral side 40 essentially locks onto the container top ridge by manually bending the press lock 75 against the container sidewall 16, 18, or 30. Alternatively, the FLS sixth bend 74 can be bent greater than 180 degrees upward from the FLS fifth section 78 so that a hook is formed. This way, this hook can function in the same manner as the FLS press lock 75 to achieve a locking result.

The second lateral side 42 is a mirror image of the first lateral side 40. The second lateral side 42 has a SLS first bend 80 that extends forward at preferably a right angle in relation to the cross-member second end 47 and the latitudinal axis 34. Extending from the SLS first bend 80 is a SLS first section 82, which is perpendicular to the latitudinal axis 34. A SLS second bend 84 extends 90 degrees upward from the SLS first section 82. A SLS second section 86 extends upward from the SLS second bend 84. The SLS second bend 84 and the SLS second section 86 are generally parallel to the second longitudinal axis 38.

A SLS third bend 88 extends 180 degrees laterally and externally from the SLS second section 86. A SLS third section 90 extends downward from the SLS third bend 88 and is generally parallel to and adjacent to the SLS second section 86. The SLS second and third sections 86 and 90 are generally parallel to the second longitudinal axis 38.

A SLS fourth bend 92 extends 180 degrees rearward from the SLS third section 90 with a SLS fourth section 98 extending from the SLS fourth bend 92 so that the SLS fourth section 98 is generally parallel with the SLS third section 90 and so that the SLS fourth section 98 and the SLS third section 90 are generally perpendicular to the SLS first section 82. The SLS fourth section 98 is spaced slightly from the SLS third section 90 so that the plastic bag handle 24 may be accepted between the SLS third section 90 and the SLS fourth section 98.

The SLS second section 86, the SLS third bend 88, the SLS third section 90, the SLS fourth bend 92, and the SLS fourth section 98 combine to define a SLS first hook 94 and a SLS first slot 96.

The SLS fourth section 98 is generally parallel to the second longitudinal axis 38 and extends beyond the SLS first hook 94. A SLS fifth bend 100 extends greater than 180 degrees rearward from the SLS fourth section 98 with a SLS fifth section 102 extending from the SLS fifth bend 100 at an acute angle in relation to the second longitudinal axis 38 and the SLS fourth section 98. The SLS fourth section 98, the SLS fifth bend 100, and the SLS fifth section 102 are generally perpendicular with the latitudinal axis 34 and combine to define a SLS second hook 104 and a SLS second slot 106. The SLS fifth section 102 is spaced from the SLS fourth section 98 so that the SLS second hook 104 may be positioned over a typical container top ridge, such as top ridge 20 or 32. The SLS fifth section 102 extends from the SLS fifth bend 100 at an acute angle so that the SLS second hook 104 positively attaches to the top ridge of the container.

A SLS sixth bend 108 extends less than 45 degrees rearward from the SLS fifth section 102. A SLS sixth section 110 extends from the SLS sixth bend 108 and is adjacent to the SLS fifth section 102. Preferably, a plastic end cap is installed over the end of the SLS sixth section 110. The SLS sixth section 110 and the SLS fifth section 102 are generally perpendicular to the latitudinal axis 34. The SLS sixth section 110, the SLS sixth bend 108, and the SLS fifth section 102 define a SLS press lock 112 so that the second lateral side 42 essentially locks onto the container top ridge by manually bending the press lock 112 against the container sidewall 16, 18, or 30. Alternatively, the SLS sixth bend 108 can be bent greater than 180 degrees upward from the SLS fifth section 102 so that a hook is formed. This way, this hook can function in the same manner as the SLS press lock 112 to achieve a locking result.

The cross-member 44, the FLS first section 48, and the SLS first section 82 define a passageway 116 so that the plastic bag and the user's hands have an unobstructed path when the bag is placed onto or removed from the device of the present invention. Even when the bag is full of garbage and the bag lateral sides are bulging outward, passageway 116 provides an unobstructed path for the bag.

Figure 5:
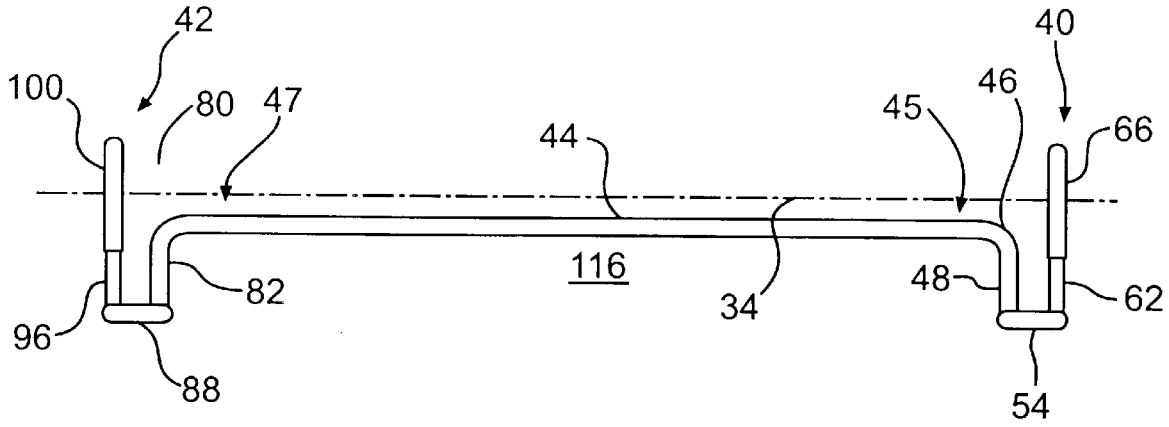
FIG. 5 is a top view of the device of the present invention.
Figure 6:
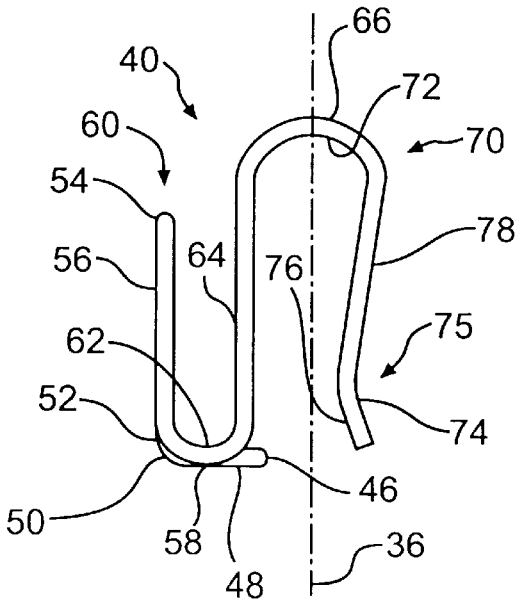
FIG. 6 is a side view of the device of the present invention.
Figure 7:
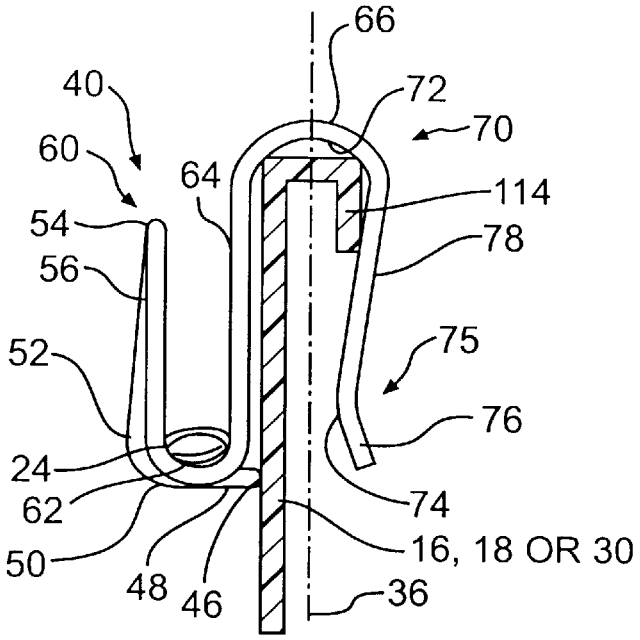
FIG. 7 is a side view of the device of the present invention shown in relation to a container and a plastic bag handle.

The device 10 is shown at rest in FIG. 5, with the cross-member 44 shown in a substantially linear position. The device 10 is made from a resilient and ductile metal, so that the device can conform to fit containers of either rounded or polygonal shapes. In another embodiment, the cross member 44 can be of an arcuate shape so that cross-member 44 acts as a spring means when positioned on the container. As shown in FIGS. 7 and 8, the typical container 14 has the sidewall 16, 18, or 30, the top ridge 20, and a container lip 114. The device 10 is positioned on the container and the second hooks 70 and 104 are positioned over the top ridge 20 so that the top ridge 20 is positioned internal of the second slots 72 and 106. The fifth sections 78 and 102 are then depressed so that the second hooks 70 and 104 are positively attached to the container top ridge 20. The press locks 75 and 112 also provide a positive attachment and lock onto the top ridge 20. The cross-member 44 in the arcuate-shaped embodiment applies pressure to the container sidewall 16 to provide additional attachment pressure to the container.

After two devices 10 are attached opposite of each other on a container top ridge 20, the plastic bag 12 is positioned inside of the container 14 with the first bag handle being positioned in a first pair of first slots 62 and 96, and the second bag handle is placed in the slots in the oppositely positioned device. The first and second lateral sides 40 and 42 are spaced approximately 6½ inches apart so that the bag handle and bag opening are stretched to near maximum condition.

Prototypes of the device of the present invention have successfully been made using 16 gauge diameter steel wire with an exterior plastic coating.

The device 10 has all smooth and rounded edges so that the possibility that the bag is torn by the device is essentially eliminated.

The above disclosed device provides a bracket for attaching an otherwise disposable plastic bag to an existing garbage container so that the bag may be used as a garbage bag liner for a container. The device has positive attachment and means for locking the device to the container. In addition, because the device only minimally cooperates with the exterior of the container and extends beyond the top of the container by only the diameter of the material used to make the device, the device may be used with a variety of containers independent of the container configuration. For example, the device of the present invention may be utilized on containers that are rectangular or circular in shape, tall or short, containers that have handles or gussets on the sidewalls, or because of the low profile of the device, even containers that have a flip-top lid or separate lid.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A device for attaching and supporting a bag within a container, the bag having two lateral sides with at least two handles extending from the lateral sides, the bag also having an opening between the lateral sides, the container having a sidewall and a top ridge, wherein at least two devices are used to attach the bag to the container, the device comprising:

a first lateral side ("FLS"), a second lateral side ("SLS"), and a cross-member, the cross-member having a first end and a second end, the cross-member first end connecting to the device first lateral side and the cross-member second end connecting to the device second lateral side;

the first lateral side and the second lateral side each adapted for securely attaching to the container and for attaching to the same plastic bag handle;

the first lateral side, the second lateral side, and the cross-member defining a passageway so that the bag may be removed from the container with essentially an unobstructed path;

the first lateral side, the second lateral side, and the cross-member defining a profile whereby a lid can be firmly placed on the top ridge of the container;

a latitudinal axis, a first longitudinal axis, and a second longitudinal axis, the longitudinal axes being generally parallel with each other and being generally perpendicular to the latitudinal axis;

the first lateral side being generally parallel with the first longitudinal axis;

the second lateral side being generally parallel with the second longitudinal axis;

the first and second lateral sides being generally parallel with each other and generally perpendicular to the latitudinal axis;

the first lateral side having a FLS first bend extending forward at an approximately right angle in relation to the cross-member first end and the latitudinal axis;

a FLS first section extending from the FLS first bend, the FLS first section being perpendicular to the latitudinal axis;

a FLS second bend extending 90 degrees upward from the FLS first section;

a FLS second section extending upward from the FLS second bend, the FLS second bend and the FLS second section being generally parallel with the first longitudinal axis;

a FLS third bend extending 180 degrees laterally and externally from the FLS second section;

a FLS third section extending downward from the FLS third bend and being generally parallel with and adjacent to the FLS second section, the FLS second and third sections being generally parallel with the first longitudinal axis;

a FLS fourth bend extending 180 degrees rearward from the FLS third section;

a FLS fourth section extending from the FLS fourth bend so that the FLS fourth section is parallel with the FLS third section and so that the FLS fourth section and the FLS third section are generally perpendicular to the FLS first section;

the FLS fourth section being spaced slightly from the FLS third section so that the plastic bag handle may be accepted between the FLS third section and the FLS fourth section;

the FLS second section, the FLS third bend, the FLS third section, the FLS fourth bend, and the FLS fourth section combining to define a FLS first hook and a FLS first slot;

the FLS fourth section being generally parallel to the first longitudinal axis and extending beyond the FLS first hook;

the FLS fifth bend extending greater than 180 degrees rearward from the FLS fourth section with a FLS fifth section extending from the FLS fifth bend at an acute angle in relation to the first longitudinal axis and the FLS fourth section;

the FLS fourth section, the FLS fifth bend, and the FLS fifth section being generally perpendicular with the latitudinal axis and combining to define a FLS second hook and a FLS second slot;

the FLS fifth section being spaced from the FLS fourth section so that the FLS second hook may be positioned over a typical container top ridge, the FLS fifth section extending from the FLS fifth bend at an acute angle so that the FLS second hook positively attaches to the top ridge of the container;

a FLS sixth bend extending less than 45 degrees rearward from the FLS fifth section;

a FLS sixth section extending from the FLS sixth bend and being adjacent to the FLS fifth section, the FLS sixth section and the FLS fifth section being generally perpendicular to the latitudinal axis;

the FLS sixth section, the FLS sixth bend, and the FLS fifth section defining a FLS press lock so that the first lateral side essentially locks onto the container top ridge by bending the FLS press lock to the container sidewall;

the second lateral side being a mirror image of the first lateral side and having a SLS first bend extending forward at an approximately right angle in relation to the cross-member second end and the latitudinal axis;

a SLS first section extending from the SLS first bend, the SLS first section being generally perpendicular to the latitudinal axis;

A SLS second bend extending 90 degrees upward from the SLS first section; a SLS second section extending upward from the SLS second bend, the SLS second bend and the SLS second section being generally parallel with the second longitudinal axis;

a SLS third bend extending 180 degrees laterally and externally from the SLS second section;

a SLS third section extending downward from the SLS third bend and being generally parallel to and adjacent to the SLS second section, the SLS second and third sections being generally parallel with the second longitudinal axis;

a SLS fourth bend extending 180 degrees rearward from the SLS third section;

a SLS fourth section extending from the SLS fourth bend so that the SLS fourth section is generally parallel with the SLS third section and so that the SLS fourth section and the SLS third section are generally perpendicular to the SLS first section;

the SLS fourth section being spaced slightly from the SLS third section so that the plastic bag handle may be accepted between the SLS third section and the SLS fourth section;

the SLS second section, the SLS third bend, the SLS third section, the SLS fourth bend, and the SLS fourth section combining to define a SLS first hook and a SLS first slot;

the SLS fourth section being generally parallel to the second longitudinal axis and extending beyond the SLS first hook;

a SLS fifth bend extending greater than 180 degrees rearward from the SLS fourth section;

a SLS fifth section extending from the SLS fifth bend at an acute angle in relation to the second longitudinal axis and the SLS fourth section;

the SLS fourth section, the SLS fifth bend, and the SLS fifth section being generally perpendicular with the latitudinal axis and combining to define a SLS second hook and a SLS second slot;

the SLS fifth section being spaced from the SLS fourth section so that the SLS second hook may be positioned over the top ridge of the container, the SLS fifth section extending from the SLS fifth bend at an acute angle so that the SLS second hook positively attaches to the top ridge of the container;

a SLS sixth bend extending less than 45 degrees rearward from the SLS fifth section;

a SLS sixth section extending from the SLS sixth bend and being adjacent to the SLS fifth section, the SLS sixth section and the SLS fifth section being generally perpendicular to the latitudinal axis; and the SLS sixth section, the SLS sixth bend, and the SLS fifth section defining a SLS press lock so that the second lateral side essentially locks onto the container top ridge by bending the SLS press lock to the container sidewall.

2. The device of claim 1, wherein the device is made from a resilient material.

3. The device of claim 2, wherein the device is made from a resilient steel wire having a plastic coated external surface.

4. The device of claim 1, wherein a plastic end cap is attached to the FLS sixth section and the SLS sixth section.

5. The device of claim 1, wherein the cross-member is substantially linear.

6. The device of claim 1, wherein the cross-member is of an arcuate shape.

7. The device of claim 6, wherein the cross-member firmly contacts the sidewall of the container.

* * * * *